US005370513A

United States Patent [19]

Fain

[11] Patent Number: 5,370,513

[45] Date of Patent: Dec. 6, 1994

[54] SCROLL COMPRESSOR OIL CIRCULATION SYSTEM

[75] Inventor: Gary K. Fain, Sidney, Ohio

[73] Assignee: Copeland Corporation, Sidney, Ohio

[21] Appl. No.: 147,115

[22] Filed: Nov. 3, 1993

[51] Int. Cl.[5] ..... F04C 18/04; F04C 29/02

[52] U.S. Cl. ..... 418/55.6; 418/88; 418/94; 418/99; 418/151

[58] Field of Search ..... 418/55.6, 88, 94, 99, 418/100, 151

[56] References Cited

U.S. PATENT DOCUMENTS

| | | | |
|---|---|---|---|
| Re. 33,236 | 6/1990 | Hazaki et al. | 418/94 |
| 4,637,786 | 1/1987 | Matoba et al. | 418/88 |
| 4,874,302 | 10/1989 | Kobayashi et al. | 418/55.6 |
| 4,886,435 | 12/1989 | Sawai et al. | 418/55.6 |
| 5,101,644 | 4/1992 | Crum et al. | 418/55.5 |
| 5,178,527 | 1/1993 | Jung | 418/55.6 |
| 5,249,941 | 10/1993 | Shibamoto | 418/55.6 |

FOREIGN PATENT DOCUMENTS

| | | | |
|---|---|---|---|
| 58-214691 | 12/1983 | Japan . | |
| 59-113290 | 6/1984 | Japan . | |
| 60-204990 | 10/1985 | Japan . | |
| 63-131889 | 6/1986 | Japan . | |
| 61-192881 | 8/1986 | Japan . | |
| 61-218792 | 9/1986 | Japan | 418/55.6 |
| 1290984 | 11/1989 | Japan . | |
| 1300080 | 12/1989 | Japan . | |
| 2-49989 | 2/1990 | Japan . | |
| 2230993 | 9/1990 | Japan | 418/151 |
| 3-81586 | 4/1991 | Japan | 418/55.6 |

*Primary Examiner*—John J. Vrablik

*Attorney, Agent, or Firm*—Harness, Dickey & Pierce

[57] ABSTRACT

A scroll compressor oil circulation system has the usual concentric bore oil pump which supplies lubricating oil to a chamber within which an impeller rotates. The rotating of the impeller within this chamber pumps lubricating oil through a passage which communicates with a control passage which injects a quantity of lubricant into the compression chambers of the scrolls for cooling and lubrication. The amount of oil injected into the compression chamber is controlled by the shape of the control passage through the orbiting scroll.

19 Claims, 4 Drawing Sheets

SCROLL COMPRESSOR OIL CIRCULATION SYSTEM

FIELD OF THE INVENTION

The present invention generally relates to scroll-type machinery. More particularly, the present invention relates to an improved lubricating system for scroll compressors which controls the oil circulation rate throughout the operating envelope of the compressor.

BACKGROUND AND SUMMARY OF THE INVENTION

Scroll machinery for fluid compression or expansion is typically comprised of two upstanding interfitting involute spiroidal wraps or scrolls which are generated about respective axes. Each respective scroll is mounted upon an end plate and has a tip disposed in contact or near contact with the end plate of the other respective scroll. Each scroll further has flank surfaces which adjoin, in moving line contact or near contact, the flank surfaces of the other respective scroll to form a plurality of moving chambers. Depending upon the relative orbital motion of the scrolls, the chambers move from the radially exterior ends of the scrolls to the radially interior ends of the scrolls for fluid compression, or from the radially interior ends of the scrolls to the radially exterior ends of the scrolls for fluid expansion. The scrolls, to accomplish the formation of the chambers, are put in relative orbital motion by a drive mechanism. Either one of the scrolls may orbit or both may rotate eccentrically with respect to one another.

A typical scroll machine, according to the design which has a non-orbiting scroll, includes an orbiting scroll which meshes with the non-orbiting scroll, a thrust bearing to take the axial loads on the orbiting scroll, and a lubricant supply system for lubricating the various moving components of the machine including the thrust bearing. Accordingly, there is a continuous need in the field of scroll machines tier improved lubricating techniques throughout the operating range of the machinery.

Conventionally, in low-side scroll compressors, a portion of the lubrication is suction gas flow which is allowed to pick up the overspray of lubricant oil from the compressor's components and circulate it throughout the compressor. Suction gas is baffled and routed through the compressor in such a way as to control the amount of oil which is picked up by the suction gas to a tolerable level for compressor operation at rated operating conditions. At the hotter "high compression ratio" conditions, where it may be desirable to have a higher oil circulation rate for its cooling effect, the oil circulation rate is actually lower. This lower oil circulation rate is the result of the suction gas being much less dense at the higher compression ratios and therefore the suction gas does not entrain as much of the oil overspray.

Accordingly, it would be desirable to control the amount of oil which is entrained by the suction gas throughout the operating range of the compressor. This would include the hot conditions which occur if high compression ratios are experienced and also the lower temperature operating ranges of the compressor. In addition, it would be desirable to provide some form of mist lubrication to prevent scroll tip galling.

It is therefore a primary objective of this invention to provide an improved lubrication system which utilizes the centrifugal forces generated by a rotating upper counter-balance weight to influence the flow of lubricating fluid in a portion of the lubrication system. The lubrication system of the present invention can provide a constant oil circulation rate over the entire operating envelope of the compressor or the present invention can be adapted to provide a nominal oil circulation rate at cooler oil temperatures and a selectively higher oil circulation rate at higher oil temperatures if desired.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
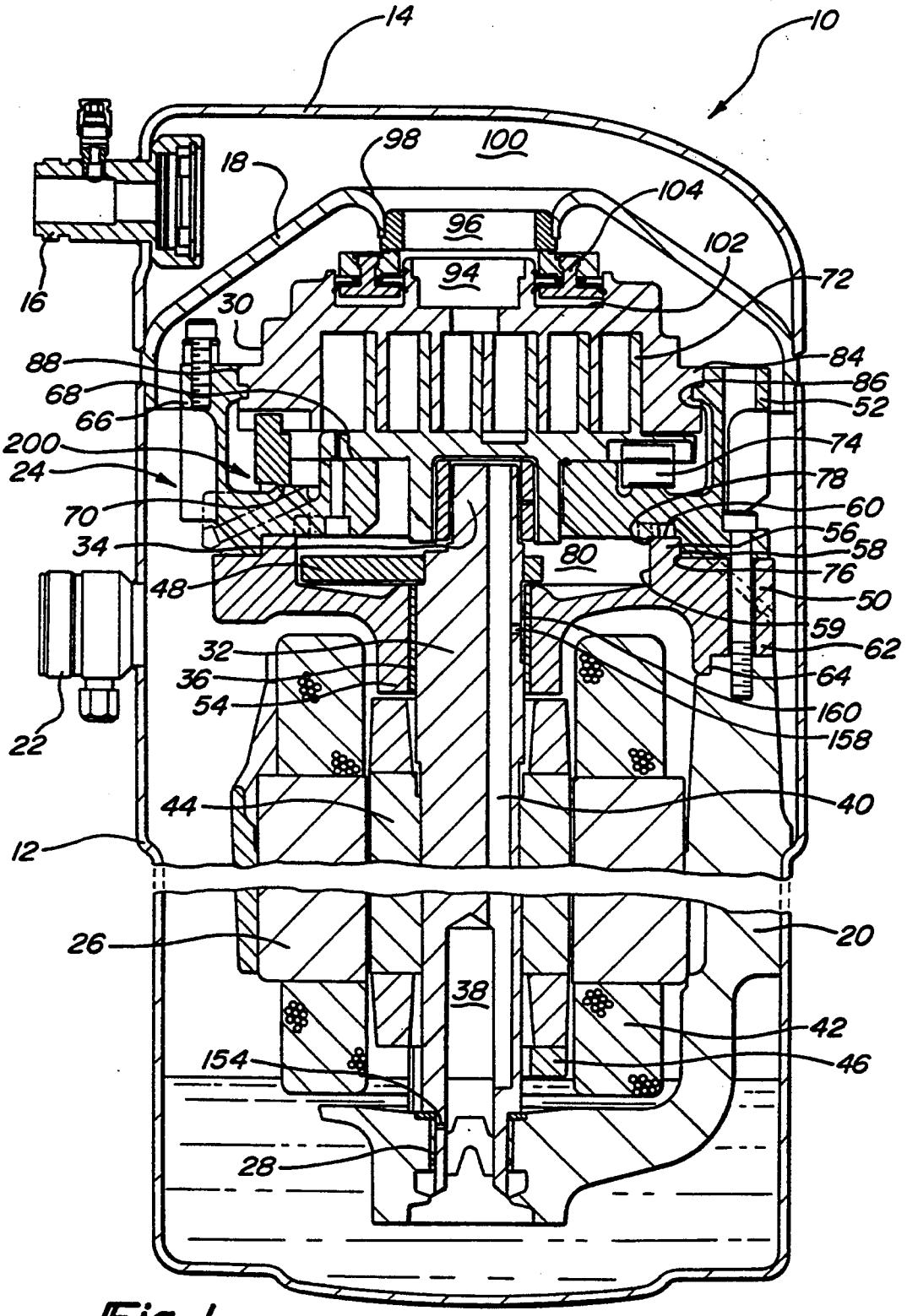
FIG. 1 is a vertical sectional view through a hermetic scroll compressor embodying the principles of the present invention.

While the present invention is suitable for incorporation into many different types of scroll machines, for exemplary purposes it will be described herein incorporated into a scroll compressor. Referring now to the drawings in which like reference numerals designate like or corresponding parts throughout the several views, there is shown in FIG. 1 a vertical sectional view of a scroll compressor 10 incorporating the lubrication system according to the present invention. Generally speaking, compressor 10 comprises a generally cylindrical hermetic shell 12 having welded at the upper end thereof a cap 14. Cap 14 is provided with a refrigerant discharge fitting 16 optionally having the usual discharge valve therein (not shown). Other elements affixed to cylindrical shell 12 include a transversely extending partition 18 which is welded about its periphery at the same point cap 14 is welded to shell 12, a lower bearing housing 20 which is affixed to shell 12 at a plurality .off points by methods known well in the art, and a suction gas inlet fitting 22.

Lower bearing housing 20 locates and supports within shell 12 a main bearing housing 24, a motor stator 26, a lower bearing 28 and a non-orbiting scroll member 30. A crankshaft 32 having an eccentric crank pin 34 at the upper end thereof is rotatably journaled in lower bearing 28 in lower bearing housing 20 and in an upper bearing 36 in main bearing housing 24. Crankshaft 32 has at its lower end the usual relatively large diameter oil-pumping concentric bore 38 which communicates with a smaller diameter bore 40 extending upwardly therefrom to the top of crankshaft 32. The lower portion of cylindrical shell 12 is filled with lubricating oil in the usual manner and the pump of bore 38 at the bottom of the crankshaft 32 is the primary pump acting in conjunction with bore 40 to pump lubricating fluid to all the various portions of the compressor which require lubrication as will be described later herein.

Crankshaft 32 is rotatably driven by an electric motor including motor stator 26 having motor windings 42 passing therethrough, and a motor rotor 44 press fit on crankshaft 32 and having a lower counterweight 46 and an upper counterweight 48.

Main bearing housing 24 includes a bearing cage 50 and an upper bearing housing 52. Bearing cage 50 has a generally cylindrical shaped central portion 54 within which the upper end of crankshaft 32 is rotatably supported by means of bearing 36. An upstanding annular projection 56 is provided on bearing cage 50 adjacent the outer periphery of central portion 54 and includes an accurately machined radially outwardly facing surface 58, an accurately machined radially inwardly facing surface 59 and an upwardly facing locating surface 60. A plurality of radially circumferentially spaced supporting arms 62 extend generally radially outwardly from central portion 54 and include axially extending portions adapted to engage and be supported on lower bearing housing 20. A step 64 is provided on the terminal end of the axially extending portion of each of the supporting arms 62 for engaging lower bearing housing 20. Step 64 is designed to mate with a corresponding recess provided on the abutting portion of lower bearing housing 20 for aiding in radially positioned bearing cage 50 with respect to lower bearing housing 20.

Upper bearing housing 52 of main bearing housing 24 is generally cup-shaped including an upper annular guide ring portion 66 integrally formed therewith, an annular axial thrust bearing surface 68 disposed below ring portion 66, and a second annular supporting bearing surface 70 positioned below and in radially outwardly surrounding relationship to axial thrust bearing surface 68. Axial thrust bearing surface 68 serves to axially movably support an orbiting scroll member 72, and supporting bearing surface 70 provides support for an Oldham coupling 74. The lower end of upper bearing housing 52 includes an annular recess defining radially inwardly and axially downwardly facing surfaces 76 and 78 respectively which are designed to mate with surfaces 58 and 60 respectively of bearing cage 50 to aid in axially and radially positioning upper bearing housing 52 and bearing cage 50 relative to each other. Additionally, a cavity 80 is designed to accommodate rotational movement of upper counterweight 48 secured to crankshaft 32 at the upper end thereof. The provision of this cavity enables counterweight 48 to be positioned in closer proximity to orbiting scroll member 72 thus enabling the overall size thereof to be reduced. In addition, counterweight 48 rotating within cavity 80 creates a counterweight pump which provides an oil pumping action for lubricating a portion of compressor 10 as will be described later herein.

Annular integrally formed guide ring 66 is positioned in surrounding relationship to a radially outwardly extending flange portion 84 of non-orbiting scroll member 30 and includes a radially inwardly facing surface 86 adapted to abut a radially outwardly facing surface 88 of flange portion 84 so as to radially position and guide axial movement of non-orbiting scroll member 30.

Non-orbiting scroll member 30 has a centrally disposed discharge passageway 94 communicating with an upwardly open recess 96 which is in fluid communication via an opening 98 in partition 18 with a discharge muffler chamber 100 defined by cap 14 and partition 18. Non-orbiting scroll member 30 further has in the upper surface thereof an annular recess 102 having parallel coaxial side walls in which is sealingly disposed for relative axial movement an annular floating seal 104 which serves to isolate the bottom of recess 102 from the presence of gas under suction and discharge pressure so that it can be placed in fluid communication with a source of intermediate fluid pressure by means of a passageway (not shown). Non-orbiting scroll member 30 is thus axially biased against orbiting scroll member 72 by the forces created by discharge pressure acting on the central portion of non-orbitirtg scroll member 30 and those created by intermediate fluid pressure acting on the bottom of recess 102. This axial pressure biasing, as well as other various techniques for supporting scroll member 30 for limited axial movement, are disclosed in much greater detail in assignee's U.S. Pat. No. 4,877,382, the disclosure of which is hereby incorporated herein by reference.

Relative rotation of the scroll members is preferably prevented by the usual Oldham coupling 74 of the type disclosed in the above referenced U.S. Pat. No. 4,877,382, however, the coupling disclosed in assignee's copending application Ser. No. 591,443 entitled "Oldham Coupling for Scroll Compressor" filed Oct. 1, 1990, U.S. Pat. No. 5,320,506, the disclosure of which is hereby incorporated herein by reference, may be used in place thereof.

The compressor is preferably of the "low side" type in which suction gas entering via gas inlet 22 is allowed, in part, to escape into shell 12 and assist in cooling the motor. So long as there is an adequate flow of returning suction gas, the motor will remain within desired temperature limits. When this flow drops significantly, however, the loss of cooling will eventually cause a temperature sensor to signal the control device to shut the machine down.

The scroll compressor as thus far broadly described is either now known in the art or is the subject matter of other pending applications for patent by applicant's assignee. The details of construction which incorporate the principles of the present invention are those which deal with a unique lubrication system, indicated generally at 200. Lubrication system 200 deals with the lubrication of the thrust bearing surface 68, venting of the lubrication system to improve reliability and the injection of a small amount of lubricating oil into the gaseous refrigerant just prior to compression to increase efficiency and reduce noise.

Figure 2:
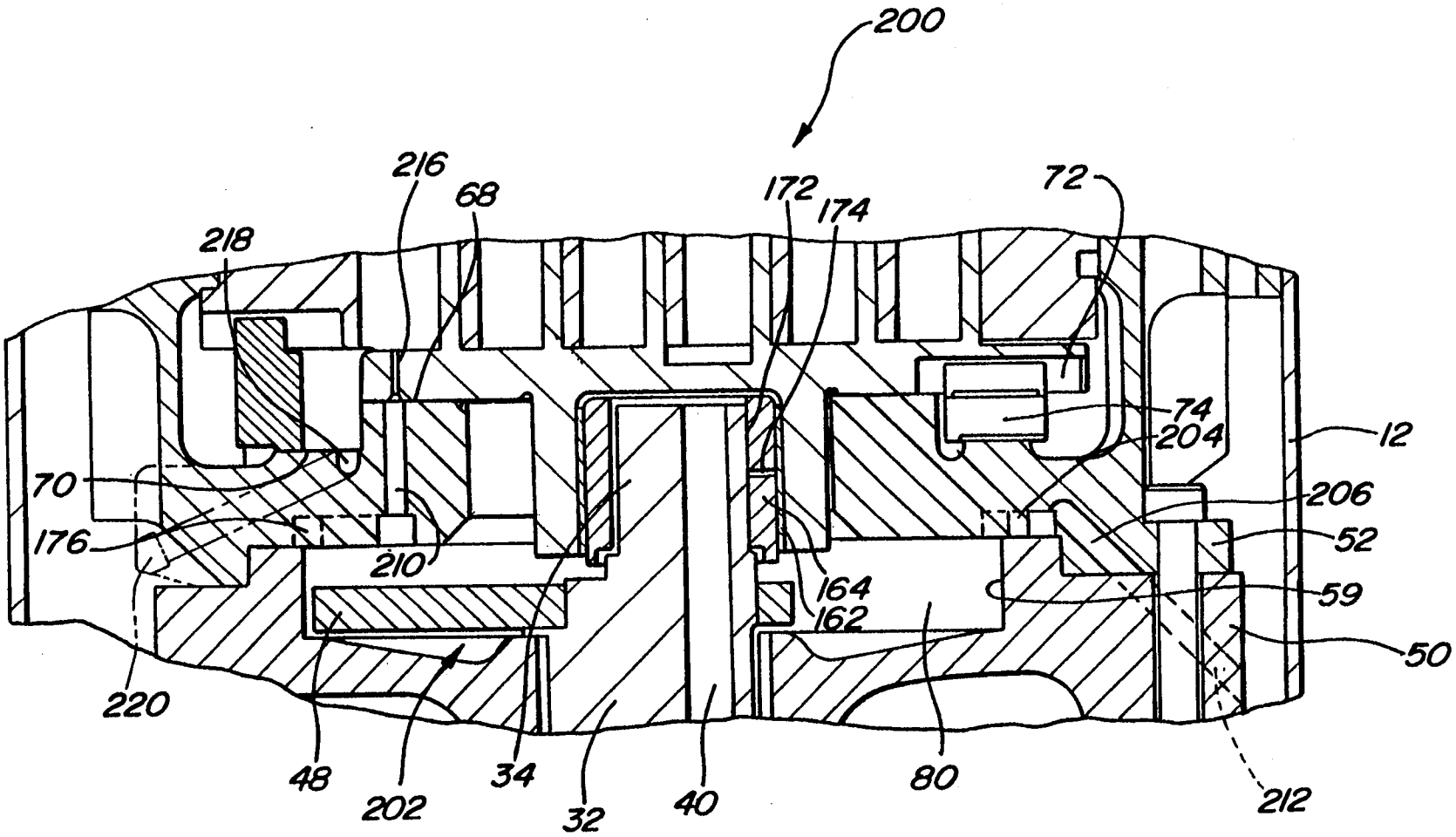
FIG. 2 is an enlarged vertical cross sectional view showing the area adjacent the upper end of the compressor of FIG. 1 embodying the principles of the present invention.
Figure 3:
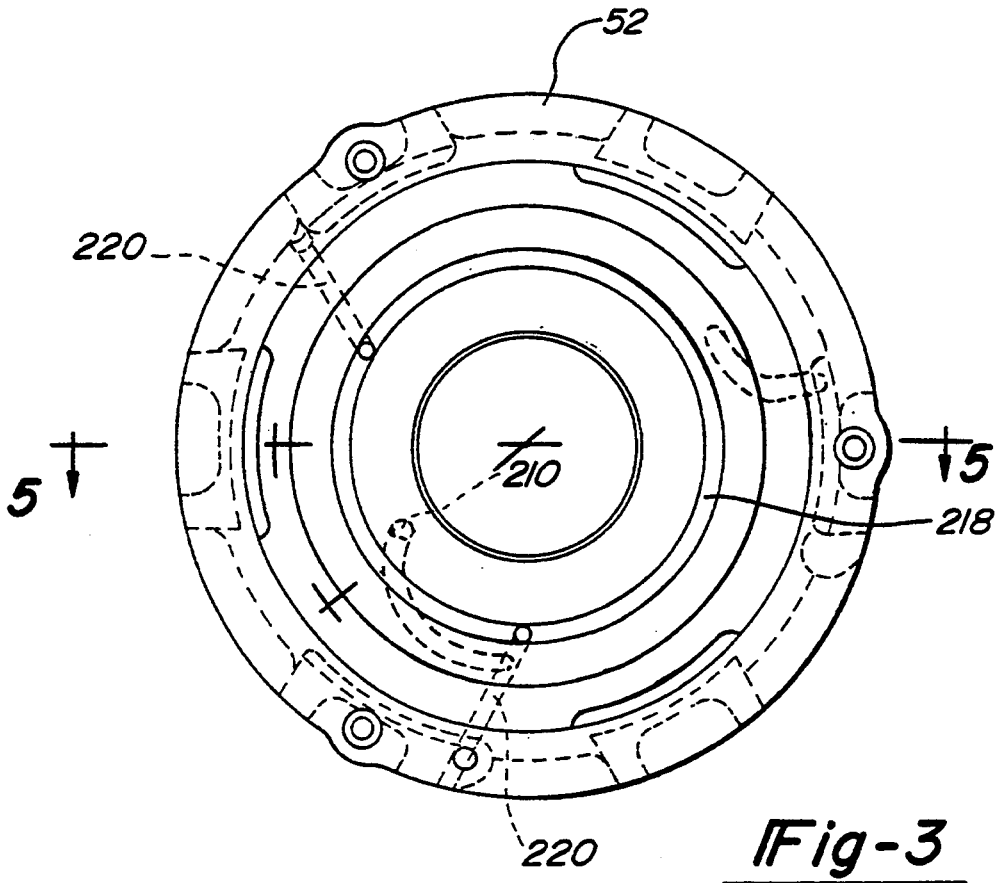
FIG. 3 is a top plan view of the upper bearing housing of the present invention.
Figure 4:
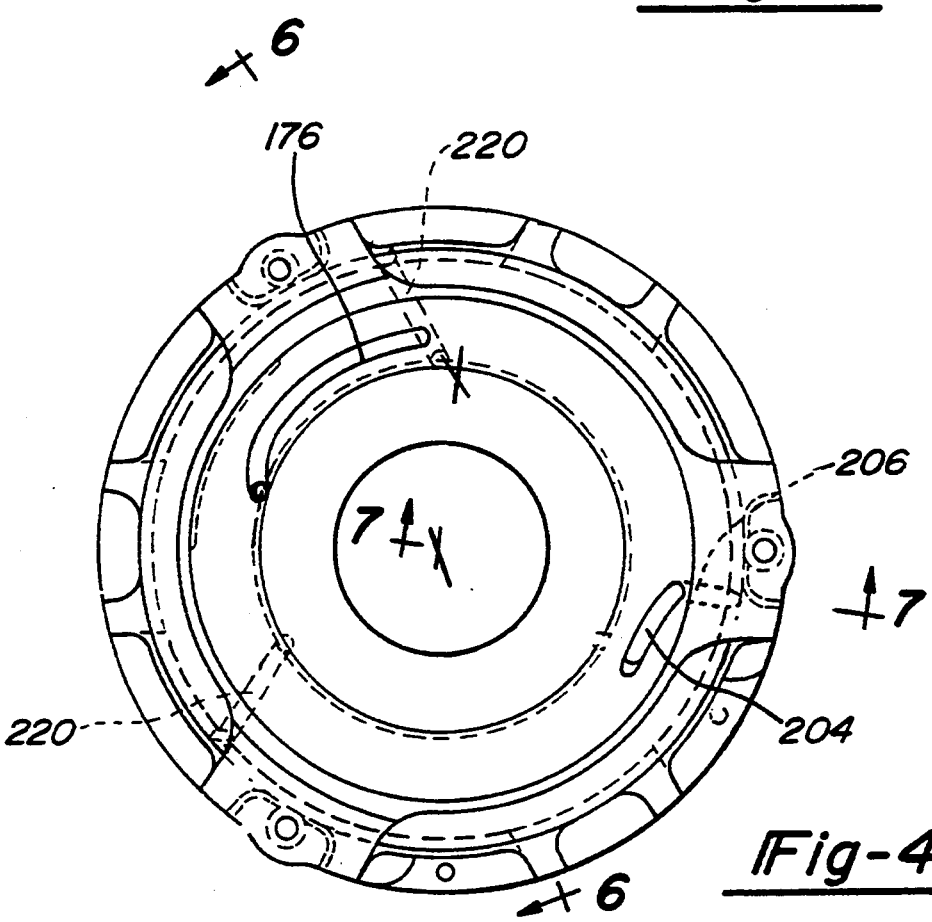
FIG. 4 is a bottom plan view of the upper bearing housing of the present invention.
Figure 5:
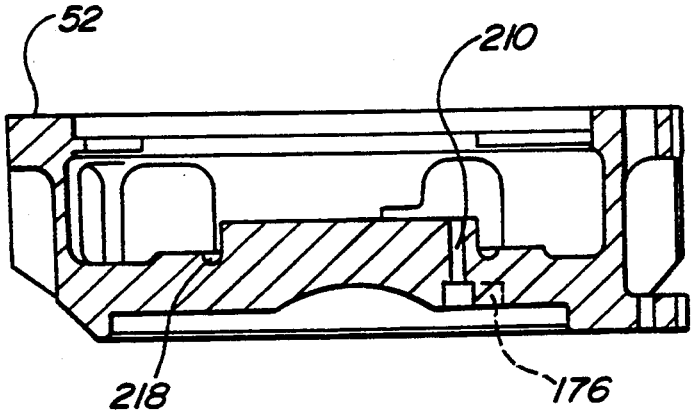
FIG. 5 is a vertical sectional view taken along line 5—5 in FIG. 3.
Figure 6:
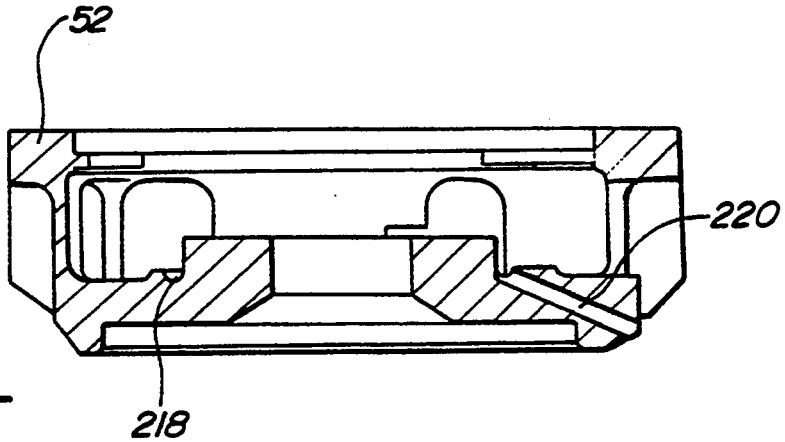
FIG. 6 is a vertical sectional view taken along line 6—6 in FIG. 4.
Figure 7:
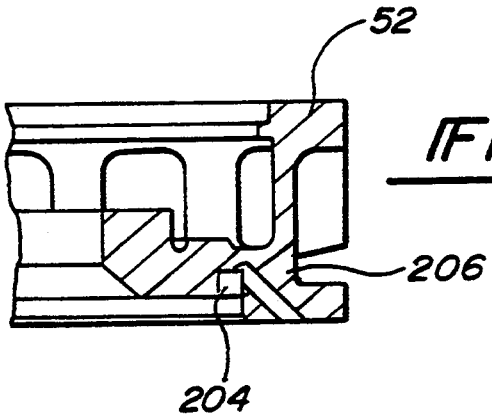
FIG. 7 is a vertical sectional view taken along line 7—7 in FIG. 4.

The lubrication system for compressor 10 begins in the lower portion of cylindrical shell 12 which is filled with lubrication oil in the usual manner. Bore 38 at the bottom of crankshaft 32 is the primary pump acting in conjunction with bore 40 to pump lubricating fluid to all the various portions of the compressor which require lubrication. A cross bore 154 extending through crankshaft 32 to bore 38 serves to provide lubricating oil to lower bearing 28. A flat (not shown) is provided on the exterior of crankshaft 32 to assist in the distribution of lubricating oil to lower bearing 28. A second cross bore 158 extends through crankshaft 32 to bore 40. Cross bore 158 serves to provide lubricating oil to upper bearing 36. A flat 160 is provided on the exterior surface of crankshaft 32 to assist in the distribution of lubricating oil to upper bearing 36. Lubricating oil that is pumped through cross bore 158 to upper bearing 36 flows around upper bearing 36 with a first portion returning to the lower portion of shell 12 and a second portion being discharged into cavity 80. As best shown in FIG. 2, the remainder of lubricating oil being pumped through bores 38 and 40 exits bore 40 at the top of crankshaft 32 to lubricate a drive bearing 162 located on eccentric crankpin 34 and an unloader bushing 164. A drive flat 172 on crankshaft 32 is provided with lubricating oil by a bleed hole 174 extending through unloader bushing 164. In addition, lubricating oil will flow through the recess between unloader bushing 164 and crankshaft 32 in order to adequately lubricate unloader bushing 164. Lubricating oil and evolved gas are discharged from the area surrounding crank pin 74 into cavity 80.

Lubrication system 200 utilizes the rotational movement of upper counterweight 48 within cavity 80 as an impeller to function as a counterweight pump 202 to pump lubricating oil from within cavity 80 to the upper scroll portion of compressor 10. Inwardly facing surface 59 of bearing cage 50 is dimensioned slightly larger than the swing diameter of upper counterweight 48. This close relationship between counterweight 48 and inwardly facing wall 59 creates a strong potential centrifugal pumping effect upon the rotation of counterweight 48, thus creating counterweight pump 202. Counterweight pump 202 creates an oil head within cavity 80 which takes lubricating oil and suction gas from cavity 80 and creates a strong vortex flow along inwardly facing wall 59 of bearing cage 50. The oil head which is produced causes the lubricating oil within cavity 80 to climb wall 59. A portion of the circular oil flow goes into a milled groove 176 located within upper bearing housing 52 which curves radially inward. The remainder being returned to cavity 80. Groove 176 ends abruptly and a portion of the lubricating oil moving within groove 176 proceeds up a vertically positioned oil circulation feed hole 210 also located within upper bearing housing 52 under its own velocity head with the remainder being returned to cavity 80. An oil circulation control hole 216 extends through orbiting scroll 72 and receives lubricating oil from oil circulation feed hole 210 as will be described later herein.

The remainder of the circular oil flow along wall 59 in cavity 80 goes into a milled groove 204 located within upper bearing housing 52 which curves radially outward and feeds into an oil discharge hole 206 in upper bearing housing 52 which is in communication with an oil discharge hole 212 in bearing cage 50. The lubricating oil proceeds through discharge holes 206 and 212 where it contacts the interior of shell 12 and slides down shell 12 to the oil sump. This pumping action by counterweight pump 202 also creates a reduced pressure in cavity 80 and thus increases the overall oil pump head of bore 38.

Second annular supporting bearing surface 70 of upper bearing housing 52 of main bearing housing 24 has an annular oil groove 218 cut into it. Oil groove 218 collects the lubricating oil discharge off of bearing thrust surface 68 and operates to supply lubricating oil to Oldham coupling 74. Two angularly drilled oil discharge holes 220 are machined from the exterior of upper bearing housing 52 of main bearing housing 24 to a point which intersects with annular oil groove 218. Thus any oil accumulating within annular oil groove 218 is drained off under the force of gravity to the lower portion of shell 12 through the two oil discharge holes 220.

The lubrication system operates to provide continuous supply of lubricating oil to the lower bearing 28, upper bearing 36, drive bearing 162, unloader 164, scroll thrust bearing surfaces 68 and 70, Oldham coupling 74 and the scroll oil circulation control system through oil circulation control hole 216. The lubricating oil begins in the sump or lower portion of shell 12 and oil is pumped up bore 38 and bore 40 to exit the top of crankshaft 32. As the lubricating oil moves up bores 38 and 40, some of the lubricating oil is directed through cross bore 154 to lower bearing 28 and through cross bore 158 to upper bearing 36. Upon exiting the top end of crankshaft 32 the lubricating oil lubricates drive bearing 162 and unloader bushing 164. Lubricating oil from upper bearing 36 and from the top end of crankshaft 32 accumulates in cavity 80. Upper counterweight 48 rotates within cavity 80 and pumps a portion of the oil within cavity 80 into milled groove 176 as well as into milled groove 204. The portion of lubricating oil pumped into milled groove 204 proceeds into discharge hole 206 and is returned to the sump through oil discharge hole 212 as detailed above. The portion of lubricating oil pumped into milled groove 176 proceeds up through oil circulation feed hole 210 to provide lubricating oil to the scroll oil circulation control system including oil circulation control hole 216. A portion of the lubricating oil pumped into milled groove 176 will overflow groove 176 and is splashed upon the thrust surface of orbiting scroll 72 by upper counterweight 48. This splash lube is transferred onto thrust bearing surface 68 by the orbiting motion of orbiting scroll 72. A sufficient amount of lubricating oil is provided to maintain the required amount of lubricating oil on thrust bearing surface 68.

The lubricating oil that is supplied to the scroll oil circulation system is a timed event. Oil circulation control hole 216, milled groove 176, and oil circulation feed hole 210 are circumferentially positioned such that as the outermost scroll inlet compressor chamber is opening, the leading edge of upper counterweight 48 passes by milled groove 176 and oil circulation feed hole 210 pumping lubricating oil through oil circulation feed hole 210. At that instant, control hole 216 is positioned to orbit directly over oil circulation feed hole 210 and thus lubricating oil flows up oil circulation feed hole 210 into control hole 216 and into the open outermost scroll inlet compression chamber.

The above described oil circulation control system ensures that the oil circulation rate is always controllable, regardless of where compressor 10 is operating in its envelope. Oil circulation rate becomes a selective feature by varying the size and shape of oil circulation control hole 216. The oil flow rate can be held constant over the operating envelope of the compressor (Option #1) or the oil flow rate can increase when the compressor is operating at higher temperatures (Option #2). As described above, when the outermost scroll inlet compression chamber opens, suction gas flow begins as suction gas enters through the opening. Control hole 216 is located at the inlet adjacent to the beginning of the open compression chamber. At the same instant control hole 216 is positioned directly over oil circulation feed hole 210, a quantity of lubricating oil is pumped through control hole 216 and into the open compression chamber. The amount of lubricating oil pumped through control hole 216 can be selected by varying the size and shape of control hole 216.

There is a pressure reduction at the top of control hole 216 equal to the dynamic pressure $PV^2/2$. Since the scroll suction process is a constant volume, the suction velocity, V, is also a constant. Therefore, the dynamic pressure reduction at the top of control hole 216 is only affected by the suction gas density. This means that in order to keep the oil circulation rate a constant (Option #1) denser suction gas will require greater oil flow:

$$\text{oil circulation rate} = \frac{\text{oil mass flow}}{\text{total mass flow}}$$

The amount of oil flowing through control hole 216 is a function of feed pressure, orifice loss and viscous loss. If we consider the feed pressure to be minimal or constant, the amount of lubricating oil flowing through control hole 216 becomes:

$$\Delta P_{hole} = K\frac{P_oQ_o^2}{2} + \frac{M_oQ_ol}{d^4}$$

where $KP_oQ_o^2/2$ is the orifice loss and $M_oQ_ol/d^4$ is the viscous loss. $P_o$ is equal to the oil density, $Q_o$ is equal to the flow rate, $M_o$ is equal to the oil viscosity, K is equal to the loss coefficient of the orifice, l is equal to the length of control hole 216 and d is equal to the diameter of control hole 216.

Figure 8:
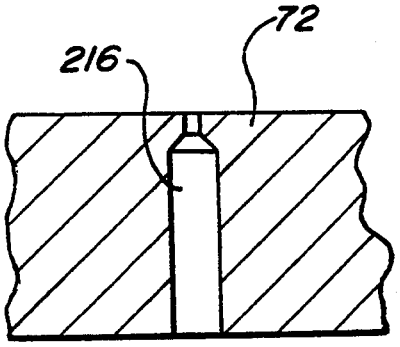
FIG. 8 is an enlarged cross sectional view showing the oil circulation control hole of the present invention.
Figure 9:
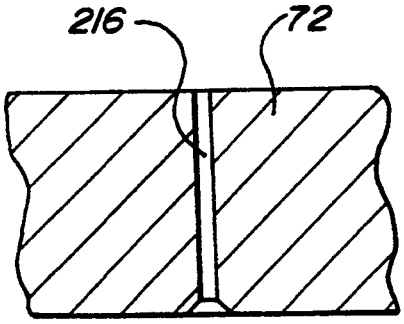
FIG. 9 is an enlarged cross sectional view similar to FIG. 8 showing the oil circulation control hole according to another embodiment of the present invention.

The rate of oil circulation when compressor 10 is operating at mid-range is considered to be the baseline. Mid-range operation of the compressor is close to ARI conditions. If it is desired to maintain a fairly uniform oil circulation rate across the envelope of operation, an orifice type hole for control hole 216 as shown in FIG. 8 is selected. This type of control hole means that the primary loss through control hole 216 will be from the orifice loss term and not the viscous loss term in the equation above. Thus, the oil circulation rate is held fairly uniform, the rate being little affected by the viscous loss. If it is desire to have an increased oil circulation rate at higher operating temperatures, a long and narrow hole for control hole 216 as shown in FIG. 9 is selected. The long and narrow control hole 216 makes viscous loss the primary factor in determining the oil circulation rate and this factor is highly dependent upon the lubricating oil temperature. Either high temperature at HCR conditions or more suction gas can both serve to lower the viscosity of the lubricating oil and thus increase the flow of oil. Thus, a higher od circulation rate is provided at a higher operating condition of compressor 10.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having on one side a first spiral vane;

a second scroll member having a second spiral vane disposed in interengaging relationship with said first spiral vane so that as said scroll members orbit with respect to one another, moving pockets of changing volume are formed by said vanes, said moving pockets moving between a suction pressure zone and a discharge pressure zone, said pockets including a first pocket for receiving a suction gas, one of said scroll members including a first passage in fluid communication with said first pocket;

means forming a chamber disposed within said suction pressure zone in fluid communication with said first passage;

an impeller disposed in said chamber;

a pump for supplying a lubricant to said chamber; and a drive member for causing said scroll members to orbit with respect to one another and said impeller to rotate, said rotating impeller being operative to pump said lubricant from said chamber through said first passage to said first pocket.

2. The scroll machine according to claim 1 wherein said first pocket opens to receive said suction gas, said first passage being located adjacent said first pocket when said first pocket is open.

3. The scroll machine according to claim 1 wherein said impeller is a counterweight rotating within said chamber.

4. The scroll machine according to claim 1 wherein said chamber is located in the vicinity of said first and second scroll members.

5. The scroll machine according to claim I wherein said first scroll member orbits with respect to said second scroll member, said first passage being located in said first scroll member.

6. The scroll machine according to claim 1 wherein said chamber is an annular chamber and said impeller is a counterweight rotating within said annular chamber.

7. The scroll machine according to claim 1 wherein said impeller pumps said lubricant through said first passage only when said first passage is adjacent to said first pocket.

8. The scroll machine according to claim 1 further comprising:

an upper bearing housing secured to one of said scroll members, said upper bearing housing including a groove formed in said upper bearing housing, a second passage having an inlet port in fluid communication with said groove and a first outlet port connecting said second passage to a first face of said upper bearing housing, said first outlet port being in intermittent communication with said first passage.

9. The scroll machine according to claim 8 wherein said upper bearing housing further includes a third passage allowing fluid to drain from said chamber.

10. The scroll machine according to claim 8 wherein said chamber is formed by said upper bearing housing and a lower bearing housing.

11. The scroll machine according to claim 8 wherein said upper bearing housing includes a second face and a fourth passage, said fourth passage allowing fluid flow between said second face and a sump.

12. A scroll machine comprising:

a first scroll member having on one side a first spiral vane;

a second scroll member having a second spiral vane disposed in interengaging relationship with said first spiral vane so that as said first scroll member orbits with respect to said second scroll member, moving pockets of changing volume are formed by said vanes, said moving pockets moving between a suction pressure zone and a discharge pressure zone, said pockets including a first pocket which opens to receive a suction gas, said first scroll member including a first passage located adjacent said first pocket when said first pocket is open;

a drive member for causing said scroll members to orbit with respect to one another, said drive member including a counterweight rotating in a chamber located in said suction pressure zone in the vicinity of said first scroll member;

a pump for supplying a lubricant from a sump to said chamber; and said machine including a passageway for allowing said lubricant to flow from said chamber through said first passage in said first scroll to said first pocket when said first pocket is open, said lubricant being pumped from said chamber to said first pocket by said rotating counterweight.

13. The scroll machine according to claim 12 wherein said first pocket is in said open position when said counterweight is adjacent said means for allowing said lubricant to flow.

14. The scroll machine according to claim 13 further comprising:

an upper bearing housing secured to said second scroll member; and wherein said passageway includes a groove formed in said upper bearing housing and a second passage in said upper bearing housing having an inlet port in fluid communication with said groove and a first outlet port connecting said second passage to a first face of said upper bearing housing, said first outlet port being in communication with said first passage in said first scroll when said first pocket is open.

15. The scroll machine according to claim 14 wherein said upper bearing housing further includes a third passage allowing fluid to drain from said chamber.

16. The scroll machine according to claim 14 wherein said chamber is formed by said upper bearing housing and a lower bearing housing.

17. The scroll machine according to claim 14 wherein said upper bearing housing includes a second face and a fourth passage, said fourth passage allowing fluid flow between said second face and said sump.

18. A scroll machine comprising:

a first scroll member having on one side a first spiral vane;

a second scroll member having a second spiral vane disposed in interengaging relationship with said first spiral vane so that as said first scroll member orbits with respect to said second scroll member, moving pockets of changing volume are formed by said vanes, said moving pockets moving between a suction pressure zone and a discharge pressure zone, said pockets including a first pocket which opens to receive a suction gas, said first scroll including a first passage located adjacent said first pocket when said first pocket is open;

an upper bearing housing secured to said second scroll member and having a first bearing surface for supporting said first scroll member, said upper bearing housing including a groove formed in the end of said upper bearing housing opposite to said first bearing surface and a second passage having an inlet port in fluid communication with said groove and a first outlet port connecting said second passage to said first bearing surface, said second passage being in communication with said first passage when said first pocket is open;

a lower bearing housing secured to said upper bearing housing, said lower bearing housing and said upper bearing housing cooperating to form a chamber located in said suction pressure zone in the vicinity of said first scroll member, said upper bearing housing including a third passage for allowing fluid to drain from said chamber;

a pump for supplying a lubricant from said sump to said chamber;

a drive member for causing said scroll members to orbit with respect to one another, said drive member including a counterweight rotating in said chamber, said counterweight being operable to pump said lubricant from said chamber to said first pocket through said first and second passages when said first pocket is open.

19. The scroll machine according to claim 18 wherein said upper bearing housing further includes a second bearing surface disposed radially outward from said first bearing surface and a fourth passage for allowing fluid flow between said second bearing surface and said sump.

* * * * *

UNITED STATES PATENT AND TRADEMARK OFFICE

CERTIFICATE OF CORRECTION

PATENT NO. : 5,370,513

DATED : December 6, 1994

INVENTOR(S) : Gary K. Fain

It is certified that error appears in the above-indentified patent and that said Letters Patent is hereby corrected as shown below:

Column 1, line 40, "tier" should be — for —.

Column 2, line 64, ".off" should be — of —.

Column 4, line 24, "non-orbitirtg" should be — non-orbiting —.

Column 5, line 45, "being returned to" should be — of the oil flow remains within —.

Column 7, line 59, "od" should be — oil —.

Column 8, line 36, "ℓ" should be the numeral — 1 —.

Column 9, line 31, "13" should be — 12 —.

Signed and Sealed this

Twenty-eight Day of March, 1995

Bruce Lehman

*Attest:*

BRUCE LEHMAN

*Attesting Officer*

*Commissioner of Patents and Trademarks*